US005358093A

United States Patent [19]

Gigante et al.

[11] Patent Number: 5,358,093

[45] Date of Patent: Oct. 25, 1994

[54] DEVICE FOR FEEDING TOBACCO ITEMS, PARTICULARLY CIGARETTES, TO A GROUPING MACHINE

[75] Inventors: Antonio Gigante; Antonio Gamberini, both of Bologna, Italy

[73] Assignee: G. D. Societa' Per Azioni, Bologna, Italy

[21] Appl. No.: 168,862

[22] Filed: Dec. 16, 1993

[30] Foreign Application Priority Data

Dec. 18, 1992 [IT] Italy ..... BO92 A 000443

[51] Int. Cl.[5] ..... B65G 47/26

[52] U.S. Cl. ..... 198/418.7; 198/418.9; 198/444

[58] Field of Search ..... 198/418, 418.7, 418.9, 198/426, 431, 444, 459, 460, 471.1

[56] References Cited

U.S. PATENT DOCUMENTS

| | | | |
|---|---|---|---|
| 1,764,663 | 6/1930 | Voigt | 198/418.7 X |
| 2,961,729 | 11/1960 | Colliva | 198/426 X |
| 4,183,429 | 1/1980 | Bald | 198/444 |
| 4,215,774 | 8/1980 | Manservisi | 198/444 |
| 4,499,987 | 2/1985 | Long | 198/426 X |
| 4,535,882 | 8/1985 | Malivoir et al. | 198/418.7 |
| 4,697,691 | 10/1987 | Zodrow et al. | 198/426 |
| 5,161,664 | 11/1992 | LeBras | 198/418.7 X |

*Primary Examiner*—James R. Bidwell
*Attorney, Agent, or Firm*—Ladas & Parry

[57] ABSTRACT

A device for feeding tobacco items, particularly cigarettes, to a grouping machine particularly a packing machine, for forming the items into groups of "n" items each; the device presenting a conveyor with seats for a succession of items featuring gaps defined by the absence of a number of consecutive items equal to "n" or a multiple thereof; a sensor for detecting a first and second incomplete group in time with the grouping machine and located respectively at the upstream end and downstream end of each gap; and a timing roller for transferring the items housed in the first group of seats into a corresponding position in the second group of seats.

3 Claims, 1 Drawing Sheet

1
2
3
4
5
7
8
9
10
11
12
13
14
15
16
17
18
19
20
21
22
23
24
25
26
27

DEVICE FOR FEEDING TOBACCO ITEMS, PARTICULARLY CIGARETTES, TO A GROUPING MACHINE

BACKGROUND OF THE INVENTION

The present invention relates to a device for feeding tobacco items to a grouping machine.

In the following description, specific reference is made, purely by way of example, to a device for feeding cigarettes from a manufacturing machine to a packing machine.

On known cigarette manufacturing lines, each packing machine is connected to the adjacent upstream machine—normally a filter assembly machine—by a respective feed device which normally provides, between the machines, for a "flexible" type connection, and generally comprises at least one compensating store. In this case, the two machines are not timed in relation to each other, and the cigarettes are fed in a disorderly manner, normally in bulk, from the upstream to the packing machine, whereas they are withdrawn in orderly manner by the packing machine. In other words, with a flexible connection of the type still widely used for feeding cigarettes to a packing machine, the cigarettes are fed in orderly manner off the upstream machine, and are subsequently disordered, only to be reordered again when fed on to the packing machine.

The above operating mode is described, for example, in Patent DE-OS 31 20 674, in which the cigarettes coming off the manufacturing machine are fed in bulk to a feedbox with a number of output channels, each designed to feed a respective seat on an ordering drum by which the cigarettes are formed into a complete orderly sequence for supply to a follow-up packing machine.

A similar operating mode obviously involves a considerable waste of energy as well as a number of drawbacks mainly due to the sequence of handling operations to which the cigarettes are subjected.

One proposal for overcoming the above drawbacks has been to connect the packing machine to the adjacent upstream machine by means of a rigid feed device featuring a reintegrating device. In this case, the two machines are permanently synchronized with each other, and the cigarettes coming off the upstream machine are transferred synchronously to the packing machine in the same orderly configuration in which they were fed off the upstream machine. As both machines are connected synchronously, the reintegrating device provides for supplying cigarettes with which to fill one or more gaps or one or more vacancies occurring at the output of the upstream machine. Here and hereinafter, the terms "vacancy" and "gap" are intended to mean the space formed on the connecting line between the two machines by the absence of one or a number of consecutive cigarettes respectively, which gaps and/or vacancies would, in the absence of reintegration, result in a shortage of one or more cigarettes in the corresponding packet formed on the packing machine, and consequently in rejection of the incomplete packet.

The above operating mode is described, for example, in Patents DE-PS 33 19 390 and DE-OS 37 05 941, in which the cigarettes coming off the manufacturing machine are fed to the packing machine by means of an intermediate feed device which receives a discontinuous succession of cigarettes, and feeds them along an internal path which gets one step shorter for each vacancy in the discontinuous succession, so as to convert the discontinuous succession into a continuous one for supply to the packing machine. When the number of compensated vacancies equals the number of cigarettes in the packet formed on the packing machine, the original length of the internal path is restored, so as to form, in the continuous succession supplied to the packing machine, a gap consisting of a sequence of vacancies equal to the number of cigarettes in each packet. Upon the gap arriving at the input of the packing machine, this provides for performing a no-load cycle.

A similar operating mode presents numerous drawbacks, mainly due to the fact that the location of the gap in the succession of cigarettes supplied to the packing machine depends on the manner—purely random in general—in which the vacancies are presented.

One consequence of the above is that the packing machine must be capable of performing a no-load cycle as of any point within the normal machine cycle. Apart from the fact that such a machine is still unheard of, even if it were to exist, it would fail to provide for entirely eliminating rejects, and would almost invariably result in the rejection of two incomplete packets upon arrival of each said gap. In fact, on almost all known packing machines, each group cigarettes forming the content of each packet is formed, not continuously, but by first forming subgroups, and only in the event the start of said gap coincides with the start of one of the subgroups would it, perhaps, be possible to avoid said two rejects.

SUMMARY OF THE INVENTION

It is an object of the present invention to provide a feed device designed to overcome the aforementioned drawbacks.

In particular, it is an object of the present invention to provide a device for supplying tobacco items, particularly cigarettes, enabling rigid connection of a known manufacturing machine of such items to a known grouping machine, in particular a packing machine, in such a manner as to eliminate rejects, and with no substantial alterations required to the machines themselves.

According to the present invention, there is provided a device for feeding tobacco items, in particular cigarettes, to a grouping machine, in particular a packing machine, for forming the items into groups of "n" items each; characterized by the fact that it comprises conveyor means with seats for a final succession of items presenting gaps defined by the absence of a number of consecutive items equal to "n" or a multiple thereof; phase detecting means for dividing the seats of said conveyor means into groups of "n" seats in time with the grouping machine; sensor means for detecting a first and second said group in time with the grouping machine and located respectively at the upstream end and downstream end of each said gap; and transfer means for transferring the items housed in said first group into a corresponding position inside said second group.

According to a preferred embodiment of the above device, said transfer means comprise a timing roller substantially tangent to said conveyor means, rotating about its axis in the same direction as and at a surface speed equal to the traveling speed of said conveyor means, and presenting "n" peripheral seats having the same spacing as the seats of said conveyor means.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figures 1, 2:
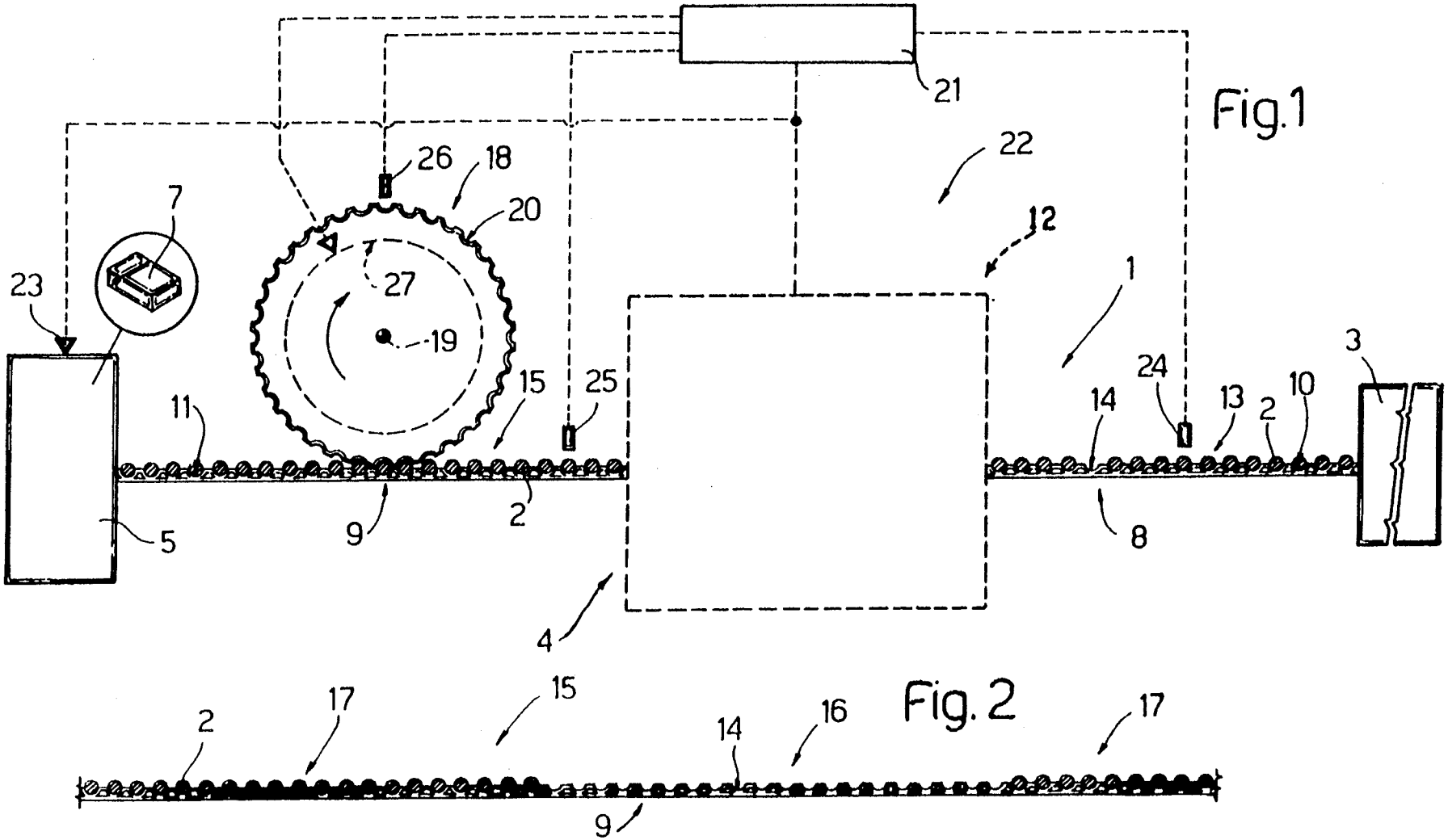
FIG. 1 shows a schematic side view, partly in blocks and with parts removed for clarity, of a preferred embodiment of the device according to the present invention.
FIG. 2 shows a schematic, larger-scale view of a detail in FIG. 1.

Number 1 in FIG. 1 indicates a line for producing and processing cigarettes 2, and comprising a manufacturing machine 3—in this case a filter assembly machine—having its output connected by a feed device 4 to the input of a grouping machine 5—in this case a packing machine—designed to receive cigarettes 2 from machine 3 and form them into groups (not shown) of "n" cigarettes 2 (in the example shown, "n" equals twenty) inside respective packets 7 fed from the output of machine 5.

Feed device 4 comprises an output conveyor 8 of machine 3, and an input conveyor 9 of machine 5, which present respective successions of seats 10 and 11 for respective cigarettes 2, and are connected to each other by a known transfer unit 12. In particular, unit 12 provides for receiving from conveyor 8 a discontinuous succession of cigarettes 2 featuring randomly distributed vacancies 14, and for so manipulating succession 13 as to supply conveyor 9, and hence machine 5, with a final succession 15 defined (FIG. 2) by a succession of gaps 16 and full portions 17, and in which each gap 16 is not necessarily timed with machine 5, but comprises a number of consecutive seats 11 equal to "n" or a multiple of "n".

Along conveyor 9, downstream from unit 12, device 4 comprises a timing roller 18 tangent to conveyor 9 and rotating about an axis 19, perpendicular to conveyor 9, in the same direction as, and at a surface speed equal to the traveling speed of, conveyor 9. Roller 18 presents "n" peripheral suction seats 20 with the same spacing as seats 11, and in time with both seats 11 and machine 5, so that each seat 20 corresponds at all times with a specific cigarette 2 inside packet 7 formed on machine 5.

Roller 18 is connected to a central unit 21 forming part of a device 22 for controlling device 4 and synchronizing roller 18 as a function of signals supplied to central unit 21 by a device 23 for detecting the phase of machine 5, and as a function of further signals received from further sensors 24, 25, 26 for detecting and communicating to central unit 21 the presence/absence of cigarettes 2 on conveyors 8 and 9 and roller 18 respectively. Central unit 21 also provides for controlling suction through seats 20 of roller 18 by means of a known distributor element 27.

The way in which roller 18 provides for timing each gap 16 in relation to machine 5 will be described by way of the following example:

Supposing, for example, that "n" equals twenty, and that, as determined by central unit 21 on the basis of signals received from device 23 and sensor 25, said gap 16 consisting of "n" consecutive vacancies 14 and detected by sensor 25 is composed, on conveyor 9, of the last fifteen cigarettes of a first packet and the first five cigarettes of a second packet immediately following the first. In this case, distributor element 27 of roller 18, which presents "n" seats 20 and rotates in time with conveyor 9, is so controlled by central unit 21 as to remove the first five cigarettes of the first packet and, after one complete turn, feed them back on to conveyor 9 and into the first five empty seats of the second packet. In this way, the first packet will be empty and the second packet full, and succession 15 will present, downstream from roller 18, a succession of gaps 16 and full portions 17 in perfect time with machine 5, which, on the arrival of a gap 16, either performs a no-load cycle or produces an empty packet 7 which is later rejected.

The above also applies to a gap 16 composed of "kn" consecutive vacancies 14, except that, in this case, roller 18 performs "k" turns prior to feeding the removed cigarettes 2 back on to conveyor 9.

We claim:

1. A device (4) for feeding tobacco items (2), in particular cigarettes, to a grouping machine (5), in particular a packing machine, for forming the items (2) into groups of "n" items (2) each; characterized by the fact that it comprises conveyor means (9) with seats (11) for a final succession (15) of items (2) presenting gaps (16) defined by the absence of a number of consecutive items (2) equal to "n" or a multiple thereof; phase detecting means (23) for dividing the seats (11) of said conveyor means (9) into groups of "n" seats in time with the grouping machine (5); sensor means (25) for detecting a first and second said group in time with the grouping machine (5) and located respectively at the upstream end and downstream end of each said gap (16); and transfer means (18) for transferring the items (2) housed in said first group into a corresponding position inside said second group.

2. A device as claimed in claim 1, characterized by the fact that said transfer means (18) comprise a timing roller (18) substantially tangent to said conveyor means (9) and rotating about its axis (19) in the same direction as, and at a surface speed equal to the traveling speed of, said conveyor means (9); the timing roller (18) presenting "n" peripheral seats (20) with the same spacing as the seats (11) of said conveyor means (9).

3. A device as claimed in claim 2, characterized by the fact that it also comprises an integrating unit (12) for orderly arranging a first generally discontinuous succession (13) of said items (2) from the manufacturing machine (3) into said final succession (15).

* * * * *

UNITED STATES PATENT AND TRADEMARK OFFICE

CERTIFICATE OF CORRECTION

PATENT NO. : 5,358,093

DATED : October 25, 1994

INVENTOR(S) : Antonio GIGANTE, et al.

It is certified that error appears in the above-indentified patent and that said Letters Patent is hereby corrected as shown below:

On title page, item 73, "D." should be -- D --.

Signed and Sealed this

Eighteenth Day of March, 1997

Bruce Lehman

*Attest:*

BRUCE LEHMAN

*Attesting Officer*

*Commissioner of Patents and Trademarks*